United States Patent [19]

Godijn

[11] 4,095,936

[45] Jun. 20, 1978

[54] POT BURNER

[75] Inventor: Willem Godijn, Hilversum, Netherlands

[73] Assignee: Research Instituut "Sesto" B.V., Hilversum, Netherlands

[21] Appl. No.: 621,243

[22] Filed: Oct. 9, 1975

[51] Int. Cl.[2] ..... F23D 5/04

[52] U.S. Cl. ..... 431/337; 431/340

[58] Field of Search ..... 431/331, 337, 338, 340, 431/342

[56] References Cited

U.S. PATENT DOCUMENTS

| | | | |
|---|---|---|---|
| 2,241,470 | 5/1941 | Miller | 431/340 |
| 3,089,537 | 5/1963 | Struijk | 431/340 X |

FOREIGN PATENT DOCUMENTS

| | | | |
|---|---|---|---|
| 1,502,501 | 10/1967 | France | 431/331 |
| 1,257,433 | 2/1961 | France | 431/340 |
| 6,600,864 | 7/1967 | Netherlands | 431/338 |
| 148,584 | 4/1967 | New Zealand | 431/340 |
| 1,134,207 | 11/1968 | United Kingdom | 431/342 |

*Primary Examiner*—Martin P. Schwadron
*Assistant Examiner*—Richard Gerard
*Attorney, Agent, or Firm*—Karl W. Flocks

[57] ABSTRACT

A burner comprising a substantially diamond-shaped housing with in the interior one or more partitions defining with the two housing walls opposite the burner mouth two or more similarly diamond-shaped burners, the partition most remote from the burner mouth having a flame opening the rim of which being bent away from the burner mouth, the burner mouth being so large that air flows entering through air supply orifices near said mouth reach to the middle or slightly beyond thereof and the bottom being recessed over some degrees in the center between the end walls of the burner.

4 Claims, 2 Drawing Figures

POT BURNER

Figure 1:
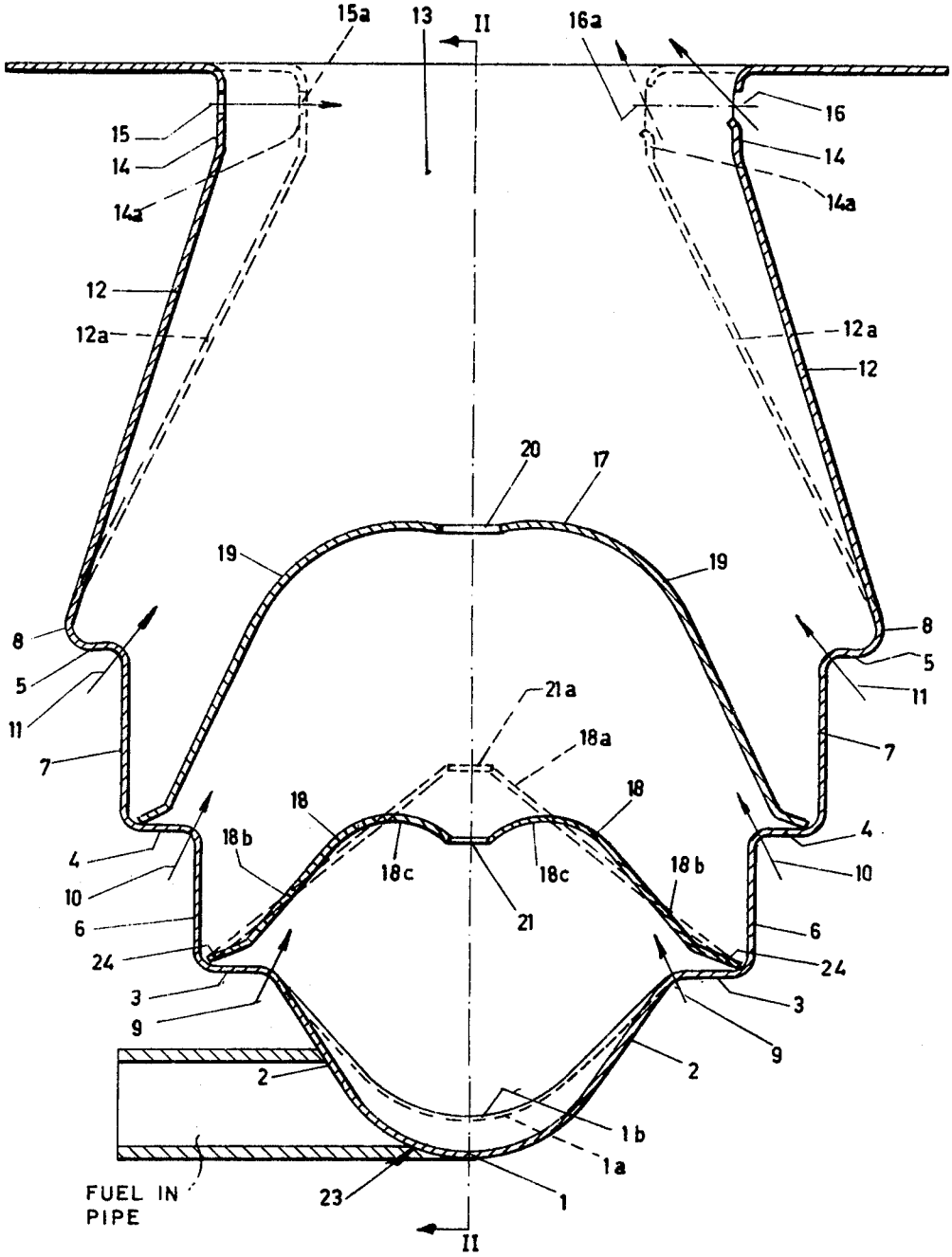

This invention relates to a burner comprising a housing of substantially diamond-shaped configuration with at the location of one of the corners the burner mouth and in the interior of the housing one or more partitions each constituted by two part-walls extending each time from one of the housing walls facing the burner mouth to the opposite housing wall, said part-walls approaching each other approximately near the axis of symmetry of the diamond extending through the burner mouth and the opposite angle while leaving a central flame opening free, such that the partitions define with the two housing walls situated opposite the burner mouth two or more burners of mainly similar diamond-shape narrowing away from the burner mouth, there being provided each time in the housing before the partitions and before the housing walls adjoining the burner mouth as well as in extensions of the latter walls extending parallel to the axis of symmetry and beyond the burner mouth air supply orifices and near the angle opposite the burner mouth a supply means for liquid fuel, the burner mouth opening being so large in section that the air flows entering through the air supply orifices in the extensions reach at least the axis of symmetry and at most do not touch the opposite wall.

Such a burner is known from the French patent specification No 1,257,433. The partition most remote from the burner mouth presents a simple flat conical or roof-like configuration, the side walls extending according to an angle of about 50° relative to the axis of symmetry. In the case of this embodiment the burner opening is generally selected such that the air flows entering the extensions through the air supply orifices just do not touch the opposite wall. If the burner has an oblong shape, the bottom facing the burner mouth is straight in the direction of the ends.

If light liquid fuels are used, as for example kerosene, a reasonable combustion is attained with such a burner. Over the entire regulating range of 1:10 a satisfactory hydroxylative combustion with a blue flame is effected, the capacity per unit of length of the oblong or trough-shaped embodiment being reasonable. The contamination of the bottom during extended service periods is negligable.

If, however, in the same burner heavy liquid fuels, for instance gasoil, are used, then the maximum attainable capacity per unit of length is reduced to 75% of the one for light liquid fuels. The regulating range too is considerably reduced to wit to 1:6. In the event of long service periods there is a considerable contamination of the burner bottom.

The New Zealand patent specification No. 148,584 furthermore discloses a burner of the afore-mentioned type in which measures have been taken to burn also heavy liquid fuels with a reasonable result. For this purpose insulating sheets are arranged around the burner proper in order to keep the temperature of the burner bottom sufficiently high to evaporate this liquid fuel with a larger boiling range completely. These measures did result in some improvement as regards the contamination of the bottom but neither the capacity nor the regulating range showed an improvement. Moreover, a new drawback presented itself, namely that for heavy liquid fuels another burner type is required than for the light fuels.

The invention now aims at providing a burner which presents not only a greater capacity than the burner known so far but, moreover, produces the same good results for light as well as for heavy fuels, namely:

a. it produces a hydroxylative combustion with the blue sootless flame over the entire and large regulating range.
b. it has the same capacity per unit of length for all liquid fuels,
c. there is no contamination worth mentioning of the burner bottom during extended service periods, for example a heating season.

According to the invention this is accomplished in that the two part-walls of the smallest partition most remote from the burner mouth each consists in section, viewed from the wall of the housing, of a flat portion extending according to approximately the same angle, but in opposite sense, relative to the axis of symmetry as the housing wall against which said partition abuts, and an arched portion being shaped such that the central flame opening left free is a few millimeters farther remote from the burner mouth than the common tangent plane to the arches, that the burner mouth opening is so large that the air flows entering through the air supply orifices in the extensions reach to the middle or slightly beyond thereof, and that in the case of an oblong shape of the burner the generating line between the angles of the diamonds formed in section opposite the burner mouth at the ends of the burner is recessed by some degrees towards the centre between the burner ends where the supply of liquid fuel is effected.

The invention therefore comprises three measures. If only one of said measures is applied in a known burner, this results in only a very slight improvement of the burner. It has surprisingly been found that only with the application of all three measures simultaneously the result aimed at is attained. In case light liquid fuels are used the maximum capacity with respect to the known burner is increased by about 50% whereas for the heavy liquid fuels an increase of capacity of even 100% is attained. The capacity of the burner is therefore of the same magnitude for heavy and for light liquid fuels. If kerosene is used one finds for the burner known from the French patent specification No. 1,257,433 of the oblong or trough-like type having a length of 40 cm. a capacity of 14.0 kW (12,000 kcal/h) whereas the burner according to the invention of the same dimensions presents a capacity of 21.0 kW (18,000 kcal/h). If the heavier gasoil is used these figures are 10.7 kW (9,200 kcal/h) and 21.0 kW (18,000 kcal/h).

The shape of the partition most remote from the burner opening probably results in the fact that the central flame opening of said partition is not only partly closed by the air flows of the admitted air, but also that this air is put into counter-current at the location of the flame opening of said partition. Apparently this also influences not only the mixing of the fuel vapour with the combustion air in a favourable way, but also prevents a too rapid escape of the fuel vapour from the lowermost burner. The consequence is that the burner becomes considerably less critical and that the tendency of combustion with a yellow flame above the flame opening in the partition most remote from the burner mouth is substantially prevented.

With respect to the normal embodiment of the known burners the burner mouth of the novel burner is about 1.5 times as large. For a trough-like burner this means that the width is 1.5 times as large as that of the known burner of the trough type whereas for a round burner this means that the diameter is about 1.25 times as large as that of the known burner of the round type. In the burner according to the invention the flame density and consequently the flame resistance will therefore be much less. This explains the fact that with the narrow burner mouth of the known burner the full burner capacity is not attained. However, this does not explain why this capacity is less for heavy liquid fuels than for light liquid fuels. An explanation probably lies in the fact that the vapours of the heavy liquid fuels are also heavier than those of the light liquid fuels (density with respect to air is 5.24 for kerosene vapour and 8.28 for gas oil vapour). Although the effect obtained can be explained in this way, it is surprising that the effect can only be brought about in combination with the two other measures according to the invention. Probably this results from the fact that by these two measures a very uniform distribution of the fuel over the entire burner contents is effected on account of which the most favourable conditions are created for the preoxidation by the air flows penetrating in the fuel vapour necessary for a slow hydroxylative combustion.

The favourable effect of the third measure, namely recessing the bottom of an oblong or trough-shaped burner by one or more degrees may be explained as follows. The evaporation of the liquid fuel is brought about by the heat of the flame conducted via the burner walls to the bottom. Now the delivery of heat to the surroundings will be least in the centre of the burner and will increase towards the ends. In other words, the bottom receives most of the heat for evaporation. On account of the recess the fuel layer on the bottom is thickest in the centre and decreases towards the ends. In other words, the thickness of the fuel layer is adapted to the heat available in the bottom for evaporation, so that an evaporation is obtained which is as complete and uniform as possible.

In a preferred embodiment of the burner according to the invention the flat portion of the part-walls of the partition most remote from the burner mouth extends according to an angle of 30°–48° relative to the axis of symmetry.

In addition it is of advantage if the arc of the arched portions of the part-walls of the partition most remote from the burner mouth is 80°–110°.

A particularly favourable embodiment of the burner according to the invention is provided if the flat portion of the part-walls of the partition most remote from the burner mouth extends according to an angle of 40° relative to the axis of symmetry, the arc of the arched portion of said part walls being 90°.

Finally it is of advantage in order not to get a disturbance of the pressure condition in the burner, that equalisation slots are arranged at the lower side of the partition most remote from the burner mouth at the point where said partition is supported by the side walls. Through these equalisation slots part of the vapour produced flows to the next compartment where said vapour is hydroxylatively combusted, a too high accumulation of pressure on account of a too rapid evaporation in the lowermost compartments being prevented.

The advantage of the burner according to the invention resides in the fact that a "general purpose" burner for liquid fuel is provided having a capacity which is greater with respect to the known burners and equal for all fuels. It is of great technical advantage that the novel burner can be manufactured at the same manufacturing cost as the burner known so far and notwithstanding the increased capacity the building-in dimensions have remained the same.

The invention will be further explained below with reference to the drawings showing by way of example an embodiment of the burner according to the invention.

The drawings show in

Figure 2:
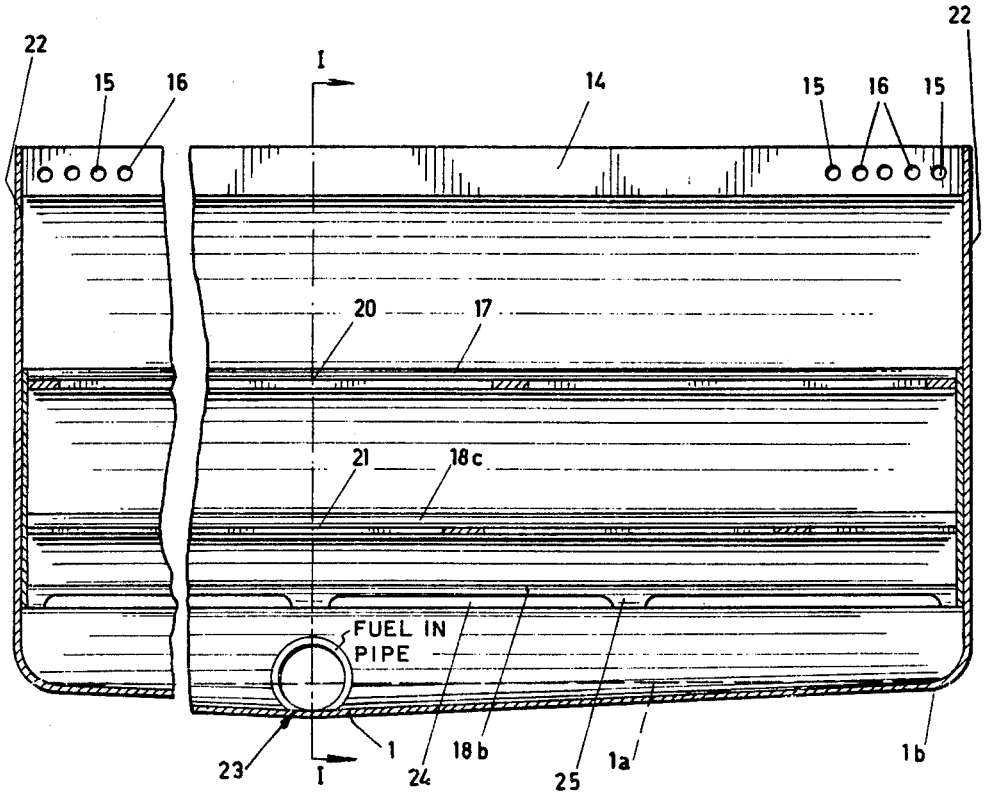

FIG. 1 a cross-section according to the line I—I of FIG. 2 of an oblong or troughed burner according to the invention in which the construction of the known burner according to the French patent specification No. 1,257,433 is shown in dotted lines;

FIG. 2 on a reduced scale a section according to the line II—II of FIG. 1.

The burner shown in FIG. 1 of the drawings is composed in practice of two parts joined near the widest part. The upper part is inverted V-shaped in cross-section, the lower part being mainly V-shaped so that together they constitute in cross-section mainly a diamond. The bottom part is rounded and constitutes a troughed evaporation chamber to which the liquid fuel is supplied near 23. From the bottom the side walls 2 diverge upwards, said side walls being stepped with horizontal portions 3–5 and vertical portions 6 and 7 and a transition portion 8. In or near the recessed angles formed between the horizontal and vertical portions there are provided air supply orifices 9–11. In general the orifices 9 extend according to an angle of about 25° relative to the axis of symmetry (section II—II), the orifices 10 according to an angle of about 27° relative to the axis of symmetry and the orifices 11 according to an angle of about 45° relative to the axis of symmetry.

The upper part comprises two side walls 12 coverging from the widest part of the burner, said side walls constituting the main burner opening 13 between their upper rims. Beyond the burner opening 13 the side walls comprise upright portions 14 in which there are provided mainly horizontal air supply openings 15 alternating with fairly steep upwardly directed air supply openings 16.

In the embodiment shown the mainly diamond-shaped burner space is subdivided by two partitions 17 and 18 into three compartments. The two partitions 17 and 18 are supported by the two lower steps 3 and 4 and are situated with their lower rims in the salient angles between said steps and the adjacent vertical wall portions 6 and 7. The upper partition 17 is in the known manner mainly roof-shaped and comprises two upwardly curved and downwardly converging part-walls 19 leaving open a gap-like flame opening 20.

The supply of combustion air to the second compartment formed below said partition 17 and above the lower partition 18 is effected through the air supply orifices 10 and according to the afore-mentioned angle such that on account of the recessed shape of the part-walls vortexes are created directly below the flame opening 20.

So far the lower partition was shaped as shown in dotted lines **18*a* in the drawing which means with mainly flat upwardly converging part-walls constituting an angle of about 50° relative to the axis of symmetry and leaving open a flame opening 21*a*, the air supply being effected through the orifices 9 according to an angle of about 45° or such that the air flows meet in or slightly below the flame opening 21*a***. This embodiment is quite satisfactory for the relatively light grades of fuel but it leaves much to be desired for heavier liquid fuels.

It has been found according to the invention that the drawbacks are removed if the lower partition 18 is shaped as shown in full lines in the drawing, namely with part-walls 18*b* extending rather steeply from the supporting faces 3, the upper ends 18*c* being arched towards one another while forming a gap-like flame opening 21. The steep flat part-walls 18*b* extend suitably according to an angle of about 30°–48° relative to the axis of symmetry and particularly according to an angle of 40°, the adjacent arched portions constituting an arc of 80°–110° and in particular an arc of about 90°. This results in an embodiment as shown in the drawings. The air supply through the orifices is such that the incoming air flows are directed substantially upon the adjacent start of the arched wall portions 18*c* of the part-wall. The air flows then impart a vortex movement to the gases in the first burner compartment closed by this lower partition such that under the flame opening 21 of said compartment a counter-current of gases is produced which prevents a too rapid escape of the gases but also brings about a very favourable mixing of gas or vapour with air.

Since per unit of time a larger amount of vapour can be produced, the pressure in the smaller burner compartment may under certain circumstances rise to such a degree that the vapour flows at a too high rate out of the flame opening resulting in a destructive combustion with a yellow flame. In order to prevent this there are provided in a preferred embodiment of the burner according to the invention equalizing slots 24 at the lower side of the partition 18 most remote from the burner mouth. This partition 18 is then supported by the horizontal portion 3 of the side wall 2 by protuberances 25. Part of the vapour produced in excess flows through said equalizing slots 24 to the following compartment where said vapour is hydroxylatively combusted.

In the known embodiment the side walls of the upper portion of the burner extended in a much flatter way, as shown in a dotted line 12*a* in FIG. 1. Consequently in the known embodiment the burner mouth 13 with the upright walls 14*a* and the air supply openings 15*a* and 16*a* is so small that the air flows entering through the openings 15*a* just do not touch the opposite wall. As is apparent from the drawings the burner mouth is 1.5 times as wide as the burner mouth of the known embodiment so that the air flows passing through the openings 15 only reach the axis of symmetry (line II—II) or slightly beyond.

In addition according to the invention the bottom 1 is recessed over some degrees in the centre between end walls 22, as shown in FIG. 2. In the prior art embodiment this was not the case, as shown by a dotted line 1*a* in the drawings. As a result of this recessed bottom a uniform evaporation of the oil on the bottom is effected.

In practice tests showed particularly favourable results with the burner according to the invention. The burner appears to be suitable for all kinds of fuel. The burner thereby presents a very stable blue combustion over the entire regulating range.

It is obvious that the burner according to the invention may also have a round shape.

I claim:

1. A burner comprising a housing having an elongated trough shape in its longitudinal direction and having walls in a substantially diamond-shaped configuration in transverse cross-section, a burner mouth located substantially at the top of said housing, a bottom portion of said trough shaped housing inclining downwards from both ends of said trough shape in the longitudinal direction and having means to receive a supply of liquid fuel, a first partition in the interior of said housing having two part-walls extending upwardly from said housing walls and forming arches extending toward each other substantially near a vertical plane of symmetry of said diamond-shaped configuration of said housing, said two part-walls having a central flame opening therebetween on the opposite side of a common tangent line to said arches from said burner mouth, said housing having orifices below said first partition, a second partition above said first partition and having two part-walls extending upwardly from said housing walls and having a flame opening therebetween, said housing having orifices below said second partition with inflowing air through said orifices, said housing extensions defining said burner mouth parallel to said vertical plane of symmetry and having orifices therein, said burner mouth having a width and said orifices in said extensions being directed to cause the inflowing air through said orifices in said extensions to flow only substantially as far as said vertical plane of symmetry or slightly beyond.

2. A burner according to claim 1, further characterized by having a flat portion of each of said part-walls of said first partition extending at an angle of between 30° and 48° relative to said plane of symmetry.

3. A burner according to claim 1 characterized by an arc of each of said arches of said part-walls of said first partition being in the range of 80° to 110°.

4. A burner according to claim 1 characterized by equalization slots arranged at the lower side of said first partition at a point where said first partition is supported by said walls of said housing.

* * * * *